US011282427B2

(12) United States Patent
Kim et al.

(10) Patent No.: US 11,282,427 B2
(45) Date of Patent: Mar. 22, 2022

(54) DISPLAY DEVICE AND METHOD OF DRIVING THE SAME

(71) Applicant: SAMSUNG DISPLAY CO., LTD., Yongin-si (KR)

(72) Inventors: Ha Neul Kim, Yongin-si (KR); Ho Cheol Kang, Yongin-si (KR); Dae Gwang Jang, Yongin-si (KR); Young Soo Hwang, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/007,543

(22) Filed: Aug. 31, 2020

(65) Prior Publication Data

US 2021/0248943 A1 Aug. 12, 2021

(30) Foreign Application Priority Data

Feb. 12, 2020 (KR) ..... 10-2020-0017194

(51) Int. Cl.
*G09G 3/20* (2006.01)

(52) U.S. Cl.
CPC ..... *G09G 3/20* (2013.01); *G09G 2310/027* (2013.01); *G09G 2310/0272* (2013.01); *G09G 2310/0278* (2013.01)

(58) Field of Classification Search
CPC ..... G09G 2310/027–0275; G09G 2300/0819; G09G 3/3233; G09G 2320/0295; G09G 2320/045; G09G 2320/0285; G09G 3/3258; G09G 3/3266; G09G 2300/043; G09G 2360/16; G09G 2310/0243; G09G 3/14; G09G 3/3275; G09G 3/3208
See application file for complete search history.

(56) References Cited

U.S. PATENT DOCUMENTS

| | | | | |
|---|---|---|---|---|
| 8,558,767 | B2 | 10/2013 | Kwon | |
| 8,558,825 | B2 | 10/2013 | Bae et al. | |
| 9,202,411 | B2 | 12/2015 | Jung et al. | |
| 2014/0176622 | A1* | 6/2014 | Jung | G09G 3/3208 345/690 |
| 2015/0187271 | A1* | 7/2015 | Bae | H01L 27/14612 345/690 |
| 2017/0004776 | A1* | 1/2017 | Park | G09G 3/3208 |

(Continued)

FOREIGN PATENT DOCUMENTS

| | | | |
|---|---|---|---|
| KR | 100893482 | B1 | 4/2009 |
| KR | 101388286 | B1 | 4/2014 |

(Continued)

*Primary Examiner* — Sanjiv D. Patel
(74) *Attorney, Agent, or Firm* — Cantor Colburn LLP

(57) ABSTRACT

A display device includes pixels coupled to scan lines, control lines, data lines, and sensing lines, a scan driver for supplying a scan signal to the scan lines and supplying a control signal to the control lines, a data driver for supplying one of an image data signal and a sensing data signal to the data lines, and a sensing circuit including an analog-digital converter ("ADC") which converts a sensing value supplied through the sensing lines into a current code in a digital form, the sensing circuit correcting the current code by reflecting a conversion characteristic of the ADC, the sensing circuit sensing characteristics of the driving transistor based on the corrected current code.

14 Claims, 12 Drawing Sheets

(56) References Cited

U.S. PATENT DOCUMENTS

| | | | | |
|---|---|---|---|---|
| 2018/0137825 | A1* | 5/2018 | An | G09G 3/3266 |
| 2019/0251900 | A1* | 8/2019 | Min | G09G 3/3291 |

FOREIGN PATENT DOCUMENTS

| | | | |
|---|---|---|---|
| KR | 101450919 | B1 | 10/2014 |
| KR | 1020150073694 | A | 7/2015 |
| KR | 1020160050831 | A | 5/2016 |
| KR | 101992665 | B1 | 6/2019 |

* cited by examiner

FIG. 7A

| REFERENCE VOLTAGE (RV) | REFERENCE GAIN (RG) |
|---|---|
| RV1 | 0.692 |
| RV2 | 0.688 |
| RV3 | 0.680 |
| RV4 | 0.672 |
| RV5 | 0.672 |
| RV6 | 0.661 |
| RV7 | 0.661 |
| RV8 | 0.612 |
| RV9 | 1 |

FIG. 7B

| REFERENCE GRAY LEVEL (RGL) | REFERENCE GAIN (RG) |
|---|---|
| G255 | 0.692 |
| G224 | 0.688 |
| G192 | 0.680 |
| G160 | 0.672 |
| G128 | 0.672 |
| G96 | 0.661 |
| G64 | 0.661 |
| G32 | 0.612 |
| G0 | 1 |

DISPLAY DEVICE AND METHOD OF DRIVING THE SAME

The application claims priority to Korean patent application 10-2020-0017194, filed on Feb. 12, 2020, and all the benefits accruing therefrom under 35 U.S.C. § 119, the content of which in its entirety is herein incorporated by reference.

BACKGROUND

1. Field

Embodiments of the invention relate to a display device and a method of driving the same. Particularly, embodiments of the invention generally relate to a display device to which an external compensation method is applied, and a method of driving the display device.

2. Description of the Related Art

A self-luminescent display device displays an image by pixels coupled to a plurality of scan lines and a plurality of data lines. Each of the pixels includes a light emitting device and a driving transistor.

The driving transistor controls an amount of current supplied to the light emitting device, corresponding to a data signal supplied from a data line. The light emitting device generates light with a predetermined luminance corresponding to an amount of current supplied from the driving transistor.

In order for the display device to display an image having uniform image quality, the driving transistor included in each of the pixels is desired to supply a uniform current to the light emitting device, corresponding to the data signal.

SUMMARY

A driving transistor included in each of pixels has a unique characteristic value in which a variation may exist. Threshold voltages and mobilities of driving transistors included in respective pixels may be different or be changed due to degradation caused by use of the driving transistors, for example. Accordingly, a luminance variation of images occurs.

Embodiments provide a display device for correcting sensing data by reflecting a conversion characteristic of an analog-digital converter according to a grayscale, which is used for external compensation.

Embodiments also provide a method of driving the display device.

An embodiment of the invention provides a display device driven in a display period for displaying an image and a sensing period for sensing a characteristic of a driving transistor included in each of pixels, the display device including the pixels coupled to scan lines, control lines, data lines, and sensing lines, a scan driver which supplies a scan signal to the scan lines and supplies a control signal to the control lines, a data driver which supplies one of an image data signal and a sensing data signal to the data lines, and a sensing circuit including an analog-digital converter ("ADC") which converts a sensing value supplied through the sensing lines into a current code in a digital form such that the sensing circuit corrects the current code by reflecting a conversion characteristic of the ADC, and senses the characteristic of the driving transistor, based on a corrected current code.

In an embodiment, the sensing period may include a first sensing period in which a first sensing value is extracted based on a first sensing data signal corresponding to a first grayscale and a second sensing period in which a second sensing value is extracted based on a second sensing data signal corresponding to a second grayscale.

In an embodiment, the data driver may supply the first sensing data signal to at least one of the pixels in the first sensing period, and supply the second sensing data signal to at least one of the pixels in the second sensing period.

In an embodiment, the sensing circuit may simultaneously calculate a mobility characteristic and a threshold voltage characteristic of the driving transistor by the first sensing value and the second sensing value.

In an embodiment, the analog-digital converter ("ADC") may generate a first current code corresponding to the first sensing value and a second current code corresponding to the second sensing value.

In an embodiment, the sensing circuit may further include a code corrector which corrects the first current code and the second current code respectively into a first correction code and a second correction code, based on the first sensing value and the second sensing value, which are supplied to the ADC, and a compensator which simultaneously calculates a mobility characteristic and a threshold voltage characteristic of the driving transistor by performing an operation on the first correction code and the second correction code, and determines a compensation value of image data, based on the mobility characteristic and the threshold voltage characteristic.

In an embodiment, the code corrector may include a gain determiner which determines a first gain corresponding to the first sensing value and a second gain corresponding to the second sensing value, and an operating component which calculates the first correction code by applying the first gain to the first current code, and calculates the second correction code by applying the second gain to the second current code.

In an embodiment, the gain determiner may include lookup table in which reference gains corresponding to predetermined reference voltages are set.

In an embodiment, the gain determiner may further include an interpolator which calculates the first gain and the second gain by interpolating some of the reference voltages with respect to each of the first sensing value and the second sensing value.

In an embodiment, the sensing circuit may further include a memory which stores at least one of the first correction code and the second correction code.

In an embodiment, the sensing circuit may further include a code corrector which corrects the first current code and the second current code respectively into a first correction code and a second correction code, based on the first grayscale and the second grayscale, and a compensator which simultaneously calculates a mobility characteristic and a threshold voltage characteristic of the driving transistor by performing an operation on the first correction code and the second correction code, and determines a compensation value of image data, based on the mobility characteristic and the threshold voltage characteristic.

In an embodiment, the code corrector may include a gain determiner which determines a first gain corresponding to the first grayscale and a second gain corresponding to the second grayscale, and an operating component which calculates the first correction code by applying the first gain to the first current code, and calculates the second correction code by applying the second gain to the second current code.

In an embodiment, the gain determiner may include a lookup table in which reference gains corresponding to predetermined reference grayscales are set.

In an embodiment, the code corrector may include a gain determiner which determines a first gain corresponding to the first grayscale and a second gain corresponding to the second grayscale, and an operating component which calculates a first sensing correction value by applying the first gain to the first sensing value, and calculates a second sensing correction value by applying the second gain to the second sensing value. The ADC may convert the first sensing correction value and the second sensing correction value respectively into the first correction code and the second correction code.

In an embodiment, a pixel disposed on an i-th (i is a natural number) horizontal line among the pixels may include a first transistor controlling a current flowing in a second node from a first power source, corresponding to a voltage of a first node, the first transistor corresponding to the driving transistor, a second transistor coupled between the first node and one of the data lines, the second transistor including a gate electrode coupled to an i-th scan line, a third transistor coupled between the second node and a j-th sensing line, the third transistor including a gate electrode coupled to an i-th control line, and a storage capacitor coupled between the first node and the second node.

In an embodiment, a length of the control signal supplied in the sensing period may be longer than that of the control signal supplied in the display period.

In an embodiment, in the sensing period, a portion of the control signal supplied to the i-th control line may overlap with the scan signal supplied to the i-th scan line, and the control signal may be supplied for a longer time duration than a time duration for which the scan signal is supplied.

Another embodiment of the invention provides a method of driving a display device, the method including supplying, to a pixel, a first sensing data signal corresponding to a first grayscale, in a first sensing period, supplying, to an ADC, a first sensing value sensed by the first sensing data signal from the pixel, in the first sensing period, correcting a first current code corresponding to the first sensing value into a first correction code by reflecting a conversion characteristic of the ADC according to a grayscale, supplying, to the pixel, a second sensing data signal corresponding to a second grayscale, in a second sensing period, supplying, to the ADC, a second sensing value generated by the second sensing data signal from the pixel, in the second sensing period, correcting a second current code corresponding to the second sensing value into a second correction code by reflecting the conversion characteristic, and simultaneously calculating a mobility characteristic and a threshold voltage characteristic of a driving transistor of the pixel by the first correction code and the second correction code, where the first sensing data signal and the second sensing data signal are different from each other.

In an embodiment, the first correction code may be calculated by applying a first gain corresponding to the first sensing value or the first grayscale to the first current code, and the second correction code may be calculated by applying a second gain corresponding to the second sensing value or the second grayscale to the second current code.

In an embodiment, the method may further include compensating for input image data, based on the mobility characteristic and the threshold voltage characteristic.

BRIEF DESCRIPTION OF THE DRAWINGS

Embodiments will now be described more fully hereinafter with reference to the accompanying drawings, in which:

FIG. 7A is a diagram illustrating an example of a gain determiner included in the code corrector shown in FIG. 6A.

FIG. 7B is a diagram illustrating an example of a gain determiner included in the code correctors shown in FIGS. 6B and 6C.

DETAILED DESCRIPTION

Figure 1:
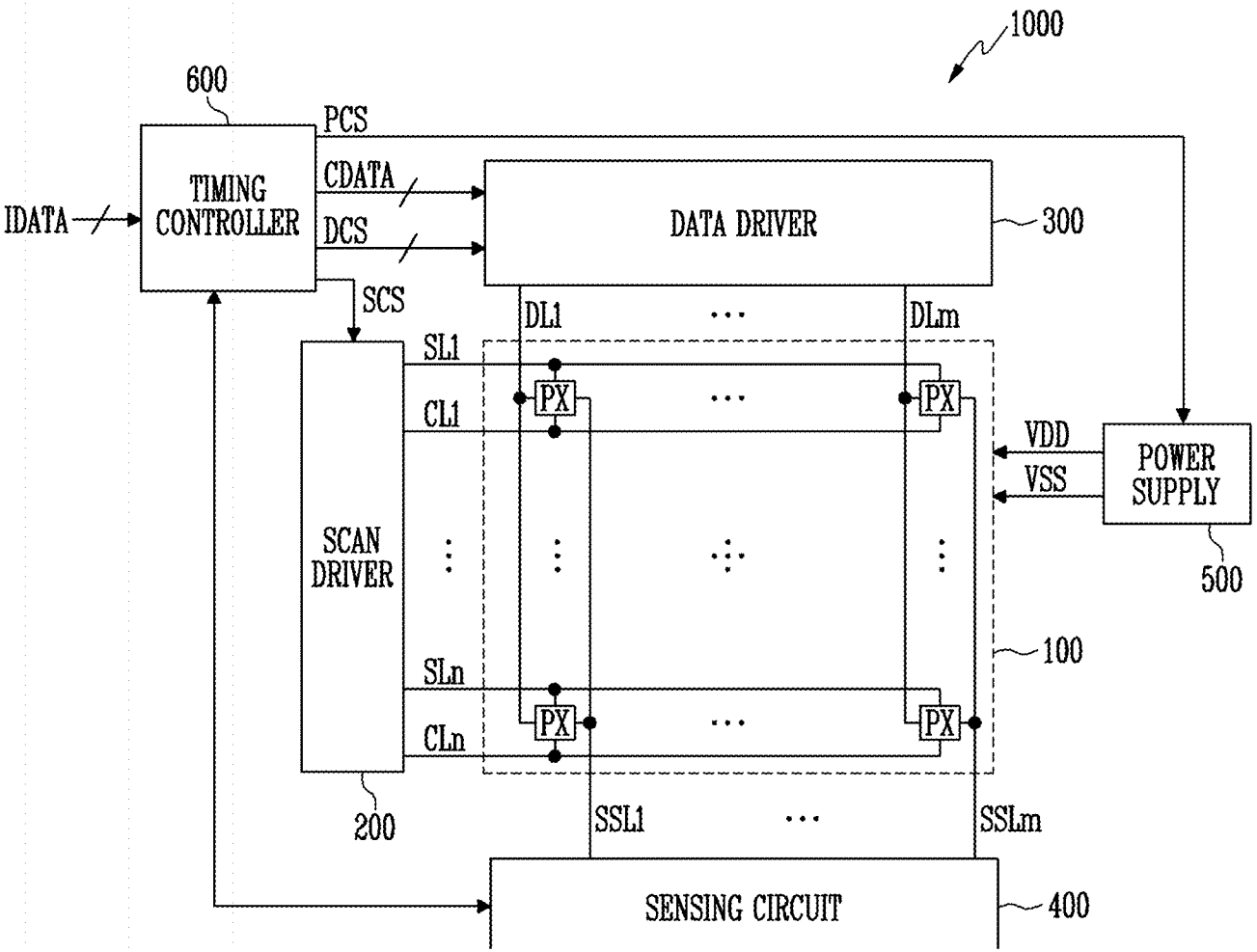
FIG. 1 is a block diagram illustrating an embodiment of a display device in accordance with the invention.

Hereinafter, embodiments of the invention will be described in more detail with reference to the accompanying drawings. Throughout the drawings, the same reference numerals are given to the same elements, and their overlapping descriptions will be omitted.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/ or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

In the drawing figures, dimensions may be exaggerated for clarity of illustration. It will be understood that when an element is referred to as being "between" two elements, it may be the only element between the two elements, or one or more intervening elements may also be present. Like reference numerals refer to like elements throughout.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating an embodiment of a display device in accordance with the invention.

Referring to FIG. 1, the display device 1000 may include a pixel unit 100, a scan driver 200, a data driver 300, a sensing circuit 400, a power supply 500, and a timing controller 600.

The display device 1000 may be a flat panel display device, a flexible display device, a curved display device, a foldable display device, or a bendable display device. Also, the display device 1000 may be applied to a transparent display device, a head-mounted display device, a wearable display device, and the like. Also, the display device 1000 may be applied to various electronic devices such as a smartphone, a tablet personal computer ("PC"), a smart pad, a television ("TV"), and a monitor.

The display device 1000 may be implemented as an organic light emitting display device, a liquid crystal display device, or the like. However, this is merely illustrative, and the configuration of the display device 1000 is not limited thereto. In an embodiment, the display device 1000 may be a self-luminescent display device including an inorganic light emitting device, for example.

In an embodiment, the display device 1000 may be driven in a display period for displaying an image and a sensing period for sensing a characteristic of a driving transistor included in each of pixels PX.

The pixel unit 100 includes pixels PX disposed to be coupled to data lines DL1 to DLm (m is a natural number), scan lines SL1 to SLn (n is a natural number), control lines CL1 to CLn, and sensing lines SSL1 to SSLm. The pixels PX may be supplied with voltages of a first power source VDD and a second power source VSS from the outside.

Although n scan lines SL1 to SLn are illustrated in FIG. 1, the invention is not limited thereto. In an embodiment, at least one control line, at least one scan line, at least one emission control line, at least one sensing line may be additionally provided corresponding to a circuit structure of the pixel PX.

In an embodiment, transistors included in the pixel PX may be implemented with an N-type oxide thin film transistor ("TFT"). In an embodiment, the oxide TFT may be a Low Temperature Polycrystalline Oxide ("LTPO") TFT. However, this is merely illustrative, and the N-type transistors are not limited thereto. In an embodiment, an active pattern (semiconductor layer) included in the transistors may include an inorganic semiconductor (e.g., amorphous silicon or poly-silicon), an organic semiconductor, or the like, for example. In addition, at least one of transistors included in the display device 1000 and the pixel PX may be replaced with a P-type transistor.

The timing controller 600 may generate a data driving control signal DCS, a scan driving control signal SCS, and a power driving control signal PCS, corresponding to synchronization signals supplied from the outside. The data driving control signal DCS generated by the timing controller 600 may be supplied to the data driver 300, the scan driving control signal SCS generated by the timing controller 600 may be supplied to the scan driver 200, and the power driving control signal PCS generated by the timing controller 600 may be supplied to the power supply 500.

Also, the timing controller 600 may supply compensated image data CDATA to the data driver 300, based on input image data IDATA. The input image data IDATA and the compensated image data CDATA may include grayscale information included in a grayscale range set in the display device.

A source start signal and clock signals may be included in the data driving control signal. The source start signal may control a sampling start time of data. The clock signals may be used to control a sampling operation.

A scan start signal, a control start signal, and clock signals may be included in the scan driving control signal SCS. The scan start signal may control a timing of a scan signal. The control start signal may control a timing of a control signal. The clock signals may be used to shift the scan start signal and/or the control start signal.

The power driving control signal PCS may control may control supply of the first power source VDD and the second power source VSS and voltage levels of the first power source VDD and the second power source VSS.

The timing controller 600 may further control an operation of the sensing circuit 400. In an embodiment, the timing controller 600 may control a timing at which a reference voltage is supplied to the pixels through the sensing lines SSL1 to SSLm and/or a current generated in the pixel PX is sensed through the sensing lines SSL1 to SSLm, for example.

The scan driver 200 may receive the scan driving control signal SCS from the timing controller 600. The scan driver 200 receiving the scan driving control signal SCS may supply a scan signal to the scan lines SL1 to SLn, and supply a control signal to the control lines CL1 to CLn.

In an embodiment, the scan driver 200 may sequentially supply a scan signal to the scan lines SL1 to SLn. When the scan signal is sequentially supplied to the scan lines SL1 to SLn, the pixels PX may be selected in a unit of a horizontal line. To this end, the scan signal may be set to a gate-on voltage (e.g., a logic high level) at which the transistors included in the pixels PX may be turned on.

Similarly, the scan driver 200 may supply a control signal to the control lines CL1 to CLn. The control signal may be used to sense (or extract) a driving current flowing in the pixel (i.e., a current flowing through the driving transistor). Timings at which the scan signal and the control signal are supplied and waveforms of the scan signal and the control signal may be differently set depending on the display period and the sensing period.

Although a case where one scan driver 200 outputs both the scan signal and the control signal is illustrated in FIG. 1, the invention is not limited thereto. In an embodiment, the scan driver may include a first scan driver for supplying the scan signal to the pixel unit 100 and a second scan driver for supplying the control signal to the pixel unit 100, for example.

The data driver 300 may be supplied with the data driving control signal DCS from the timing controller 600. In the sensing period, the data driver 300 may supply, to the pixel unit 100, a data signal (e.g., a sensing data signal) for pixel characteristic detection. In the display period, the data driver 300 may supply a data signal for image display to the pixel unit 100, based on the compensated image data CDATA.

The sensing circuit 400 may generate a compensation value for compensating for a characteristic value of the pixels PX, based on sensing values provided from the sensing lines SSL1 to SSLm. In an embodiment, the sensing circuit 400 may detect and compensate for a change in threshold voltage of the driving transistor included in the pixel PX, a change in mobility of the driving transistor, a change in characteristic of the light emitting device included in the pixel PX, and the like, for example.

In an embodiment, the sensing circuit 400 may detect a first sensing value corresponding to (or, based on) a first grayscale in a first sensing period, and detect a second sensing value corresponding to a second grayscale in a second sensing period. The first grayscale may be a first test grayscale for current sensing, and the second grayscale may be a second test grayscale different from the first grayscale.

The sensing circuit 400 may simultaneously calculate a threshold voltage characteristic and a mobility characteristic of the driving transistor of a pixel PX by an operation of the first sensing value and the second sensing value, and compensate for image data about the corresponding pixel PX, based on the threshold voltage characteristic and the mobility characteristic. In an embodiment, the first and second sensing values may be respectively replaced (or converted) with (or into) sensing currents in a saturation region of the driving transistor, for example. When the sensing currents and voltage values corresponding to the first and second grayscales are applied to a current-voltage relational expression in the saturation region of the driving transistor, two equations using the threshold voltage characteristic and the mobility characteristic as variables may be derived. When the two equations are solved, the threshold voltage characteristic and the mobility characteristic of the driving transistor of the corresponding pixel PX may be calculated together.

A compensation method in the embodiments of the invention, in which external compensation for a pixel PX is performed by sensing currents for two grayscales, may be defined by a 2-point current sensing method.

In an embodiment, during the sensing period, the sensing circuit 400 may supply a predetermined reference voltage (or initialization voltage) to the pixels PX through the sensing lines SSL1 to SSLm, and receive a current or voltage extracted from the pixel PX. The extracted current or voltage may correspond to a sensing value, and the sensing circuit 400 may detect a characteristic change of the driving transistor, based on the sensing value. The sensing circuit 400 may calculate a compensation value for compensating for input image data IDATA, based on the detected characteristic change. The compensation value may be provided to the timing controller 600 or the data driver 300.

In an embodiment, the sensing circuit 400 may include an analog-digital converter ("ADC") which converts a sensing value supplied through the sensing lines SSL1 to SSLm into a current code in a digital form. The sensing circuit 400 may correct a current code by reflecting a conversion characteristic of the ADC, and measure a characteristic of the driving transistor, based on the corrected current code.

During the display period, the sensing circuit 400 may supply a predetermined reference voltage for image display to the pixel unit 100 through the sensing lines SSL1 to SSLm.

Although a case where the sensing circuit 400 is a component separate from the timing controller 600 is illustrated in FIG. 1, at least a portion of the sensing circuit 400 may be included in the timing controller. In an embodiment, the sensing circuit 400 and the timing controller 600 may be provided as one driving integrated circuit ("IC"), for example. Further, the data driver 300 may also be included in the timing controller 600. Therefore, at least some of the sensing circuit 400, the data driver 300, and the timing controller 600 may be provided as one driving IC.

The power supply 500 may supply the voltage of the first power source VDD and the voltage of the second power source VSS to the pixel unit 100, based on the power driving control signal PCS. In an embodiment, the first power source VDD may determine a voltage (e.g., a drain voltage) of a first electrode of the driving transistor, and the second power source VSS may determine a cathode voltage of the light emitting device.

Figure 2:
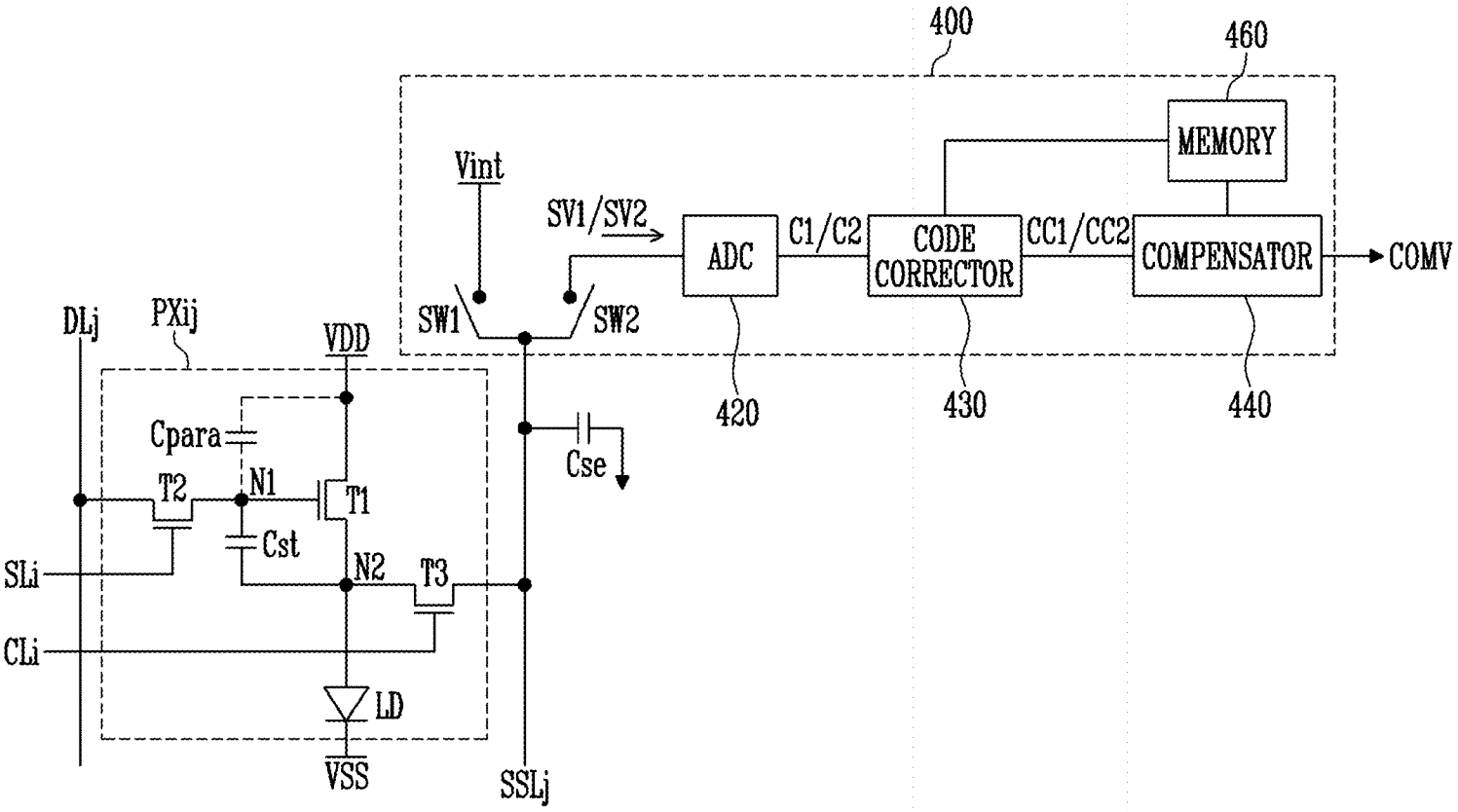
FIG. 2 is a diagram illustrating an example of a pixel and a sensing circuit, which are included in the display device shown in FIG. 1.

FIG. 2 is a diagram illustrating an example of the pixel and the sensing circuit, which are included in the display device shown in FIG. 1.

For convenience of description, a pixel which is disposed on an i-th (i is a natural number equal to or less than n) horizontal line and is coupled to a j-th (j is a natural number equal to or less than m) data line DLj is illustrated in FIG. 2.

Referring to FIG. 2, the pixel PXij may include a light emitting device LD, a first transistor T1 (driving transistor), a second transistor T2, a third transistor T3, and a storage capacitor Cst.

A first electrode (e.g., anode electrode or cathode electrode) of the light emitting device LD may be coupled to a second node N2, and a second electrode (e.g., cathode electrode or anode electrode) of the light emitting device LD may be coupled to the second power source VSS. The light emitting device LD generates light with a predetermined luminance corresponding to an amount of current supplied from the first transistor T1.

A first electrode of the first transistor T1 may be coupled to the first power source VDD, and a second electrode of the first transistor T1 may be coupled to the first electrode of the light emitting device LD. A gate electrode of the first transistor T1 may be coupled to a first node N. The first transistor T1 controls an amount of current flowing through the light emitting device LD, corresponding to a voltage of the first node N1.

A first electrode of the second transistor T2 may be coupled to the data line DLj, and a second electrode of the second transistor T2 may be coupled to the first node N1. A gate electrode of the second transistor T2 may be coupled to a scan line SLi. The second transistor T2 may be turned on when a scan signal is supplied to the scan line SLi, to transfer a data signal from the data line DLj to the first node N1.

The third transistor T3 may be coupled between a sensing line SSLj and the second electrode (i.e., the second node N2) of the first transistor T1. A gate electrode of the third transistor T3 may be coupled to a control line CLi. The third transistor T3 may be turned on when a control signal is supplied to the control line CLi, and may electrically couple the sensing line SSLj to the second node N2 (i.e., the second electrode of the first transistor T1).

In an embodiment, when the third transistor T3 is turned on, an initialization voltage Vint may be supplied to the second node N2. In another embodiment, when the third transistor turned on, a current generated by the first transistor T1 may be supplied to the sensing circuit 400.

The storage capacitor Cst may be coupled between the first node N1 and the second node N2. The storage capacitor Cst may store a voltage corresponding to a voltage difference between the first node N1 and the second node N2.

In the embodiment of the invention, the circuit structure of the pixel PXij is not limited by FIG. 2. In an embodiment, the light emitting device LD may be disposed between the first power source VDD and the first electrode of the first transistor T1.

In addition, a parasitic capacitor Cpara may be generated between the gate electrode (i.e., the first node N1) and a second (e.g., drain) electrode of the first transistor T1.

A sensing capacitor Cse in which a sensed voltage is charged may be coupled to the sensing line SSLj. A sensing current flowing in the sensing line SSLj may be measured based on a voltage (or charge quantity) charged in the sensing capacitor Cse. The sensing current may be defined as a driving current in a saturation region of the first transistor T1.

In an embodiment, the sensing circuit 400 coupled to the sensing line SSLj may include a first switch SW1, a second switch SW2, an ADC 420, a code corrector 430, a compensator 440, and a memory 460.

The first switch SW1 and the second switch SW2 may be alternately turned on. When the first switch SW1 is turned on, the initialization voltage Vint is supplied to the second node N2. Therefore, a voltage of the second node N2 (e.g., a source voltage of the first transistor T1) may be initialized to the initialization voltage Vint.

When the second switch SW2 is turned on, a sensing current of the pixel PXij may flow in the sensing circuit 400. In an embodiment, a voltage (or charge quantity) charged in the sensing capacitor Cse may be supplied to the ADC 420, for example.

The ADC 420 may convert a sensing value (e.g., a voltage value) supplied through the sensing line SSLj during a predetermined sampling period (or sensing period) into a current code in a digital form. In an embodiment, a first sensing value SV1 in a first sensing period may be converted into a first current code C1, and a second sensing value SV2 in a second sensing period may be converted into a second current code C2, for example.

In an embodiment, the first current code C1 and/or the second current code C2 may be stored in the memory 460. The current code stored in the memory 460 may be read in code correction.

In an embodiment, the ADC 420 may generally include a semiconductor element such as a metal oxide semiconductor ("MOS"). Accordingly, a process variation may exist, and a characteristic (e.g., output characteristic or conversion characteristic) of the ADC 420 may be changed depending on the magnitude (or grayscale) of a voltage supplied to the ADC 420. Therefore, a current code output from the ADC 420 does not reflect an actual sensing value, and a compensation error may occur in a measured grayscale.

In particular, when a difference between voltages supplied to the ADC 420 is large in a 2-point current sensing method, a detection error with respect to a characteristic of the first transistor T1 according to an error of a sensing value increases, and degradation compensation efficiency may be decreased.

The code corrector 430 may correct the first current code C1 and the second current code C2 respectively into a first correction code CC1 and a second correction code CC2, based on the first sensing value SV1 and the second sensing value SV2 (or a first grayscale and a second grayscale). That is, the code corrector 430 may calculate the first correction code CC1 and the second correction code CC2 by correcting an actual characteristic of the ADC 420 in an ideal form for calculating a threshold voltage and a mobility.

The compensator 440 may simultaneously calculate a mobility characteristic and a threshold voltage characteristic of the first transistor T1, based on the first correction code CC1 and the second correction code CC2. The compensator 440 may determine a compensation value COMV of input image data IDATA, based on the mobility characteristic and the threshold voltage characteristic.

The memory 460 may store at least one of the first current code C1, the second current code C2, the first correction code CC1, and the second correction code CC2. Also, the memory 460 may include conversion characteristic-related information of the ADC 420. The conversion characteristic-related information of the ADC 420 may be obtained through a test performed before the display device 1000 is released, and be recorded in the memory 460.

In some embodiments, the memory 460 may further include a lookup table desired for image data compensation, and the like.

Although a case where the first and third transistors T1 to T3 are implemented with an n-channel (–) metal-oxide-semiconductor ("NMOS") transistor has been illustrated in FIG. 2, the invention is not limited thereto. In an embodiment, at least one of the first and third transistors T1 to T3 may be provided as a p-channel (+) metal-oxide-semiconductor ("PMOS") transistor.

Figure 3:
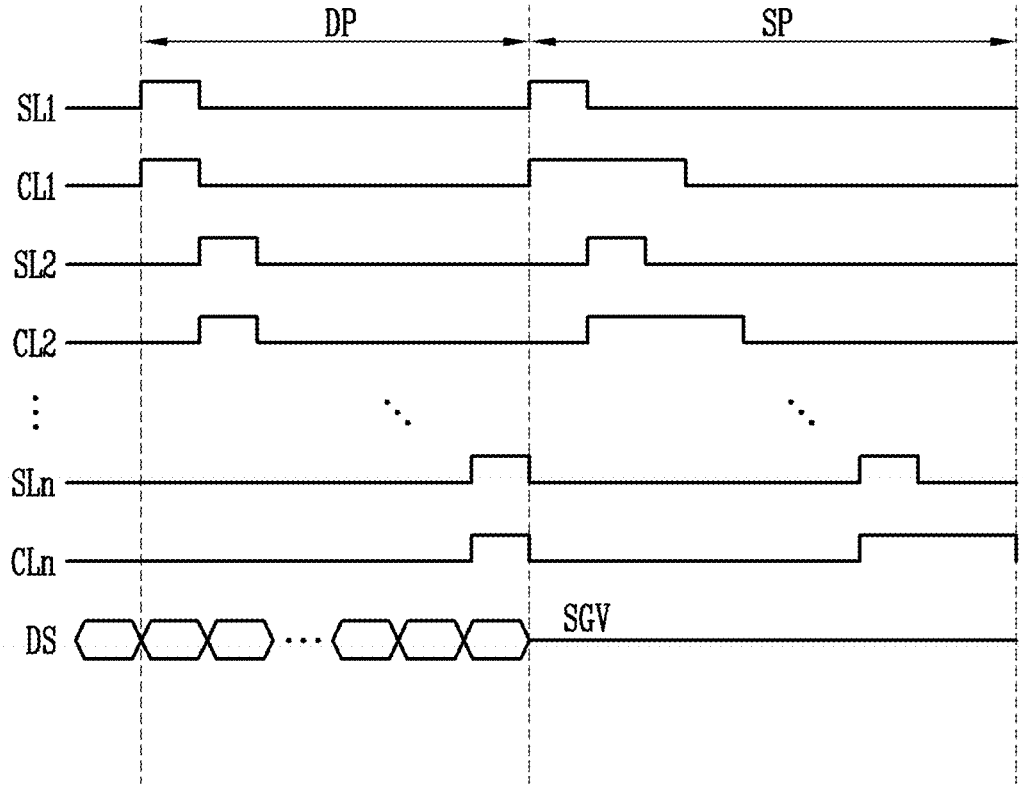
FIG. 3 is a timing diagram illustrating an example of an operation of the display device shown in FIG. 1.

FIG. 3 is a timing diagram illustrating an example of an operation of the display device shown in FIG. 1.

Referring to FIGS. 1 to 3, the display device 1000 may be driven in a display period DP for displaying an image and a sensing period SP for sensing a characteristic of the first transistor T1 included in each of the pixels PX.

In an embodiment, in the sensing period SP, image data may be compensated based on sensed characteristic information.

During the display period DP, the first switch SW1 may be turned on, and the second switch SW2 may be set to a turn-off state. Therefore, the initialization voltage Vint as a constant voltage may be supplied to the sensing lines SSL1 to SSLm.

During the display period DP, the scan driver 200 may sequentially supply a scan signal to the scan lines SL1 to SLn. Also, during the display period DP, the scan driver 200 may sequentially supply a control signal to the control lines CL1 to CLn.

With respect to an i-th horizontal line, the scan signal and the control signal may be substantially simultaneously supplied. Therefore, the second transistor T2 and the third transistor T3 may be simultaneously turned on or turned off.

When the second transistor T2 is turned on, a data signal DS corresponding to the image data may be supplied to the first node N1. When the third transistor T3 is turned on, the initialization voltage Vint may be supplied to the second node N2. Therefore, the storage capacitor Cst may store a voltage corresponding to a voltage difference between the data signal DS and the initialization voltage Vint.

Since the initialization voltage Vint is set as the constant voltage, the voltage stored in the storage capacitor Cst may be stably determined by the data signal DS.

The supply of the scan signal and the control signal to the i-th scan line SLi and the i-th control line CLi is stopped, the second transistor T2 and the third transistor T3 may be turned off.

Subsequently, the first transistor T1 may control an amount of current (driving current) supplied to the light emitting device LD, corresponding to the voltage stored in the storage capacitor Cst. Accordingly, the light emitting device LD may emit light with a luminance corresponding to the driving current of the first transistor T1.

In an embodiment, during the sensing period SP, the scan driver 200 may sequentially supply a scan signal to the scan lines SL1 to SLn. Also, during the display period DP, the scan driver 200 may sequentially supply a control signal to the control lines CL1 to CLn.

In an embodiment, a length of the control signal supplied during the sensing period SP may be longer than that of the control signal supplied during the display period DP. In addition, in the sensing period SP, a portion of the control signal supplied to the i-th control line CLi may overlap with the scan signal supplied to the i-th scan line SLi. The length of the control signal may be longer than that of the scan signal. In an embodiment, the control signal supplied to the i-th control line CLi may start being simultaneously supplied together with the scan signal supplied to the i-th scan line SLi, and be supplied for a longer time duration than a time duration for which the scan signal is supplied.

When the scan signal and the control signal are simultaneously supplied, the second and third transistors T2 and T3 are turned on. The first switch SW1 is in a turn-on state. When the second transistor T2 is turned on, a sensing data signal SGV (or sensing data voltage) for sensing may be supplied to the first node N1. At the same time, the initialization voltage Vint may be supplied to the second node N2 by the turn-on of the third transistor T3. Accordingly, a voltage corresponding to a voltage difference between the sensing data signal SGV and the initialization voltage Vint may be stored in the storage capacitor Cst.

Subsequently, when the supply of the scan signal is stopped, the second transistor T2 may be turned off. When the second transistor T2 is turned off, the first node N1 is floated. Accordingly, the voltage of the second node N2 is increased, and a sensing current is generated through the first transistor T1. While the voltage is being increased, the sensing current flows in the sensing line SSLj, and a charge quantity (i.e., a voltage) may be charged in the sensing capacitor Cse. The speed at which the voltage is increased may be changed depending on a current ability, i.e., a mobility of the first transistor T1.

In addition, a voltage division between the storage capacitor Cst and the parasitic capacitor Cpara may be made by the parasitic capacitor Cpara, and a gate-source voltage may be unintentionally changed. Therefore, compensation for a voltage drop caused by the parasitic capacitor Cpara may be performed together with compensation for the gate-source voltage.

After the voltage is increased for a predetermined time, the second switch SW2 may be turned on such that the sensing lines SSLj and the ADC 420 of the sensing circuit 400 are coupled to each other. Accordingly, the ADC 420 may generate a current code corresponding to the voltage stored in the sensing capacitor Cse (i.e., corresponding to a sensing value or sensing current).

As described above, the code corrector 430 may correct the current code so as to remove an error caused by a conversion characteristic of the ADC 420. Accordingly, a compensation error caused by an external compensation method according to 2-point current sensing may be considerably decreased, compensation efficiency may be maximized, and image quality may be improved.

In some embodiments, the sensing period SP may be performed at least once before the display device 1000 is released. Initial characteristic information of the first transistors T1 is stored before the display device 1000 is released, and input image data IDATA is compensated using the characteristic information, so that the pixel unit 100 may display an image having uniform image quality.

Also, the sensing period SP may be performed for every predetermined time even when the display device 1000 is actually used. In an embodiment, the sensing period SP may be disposed at a portion of a time duration for which the display device 1000 is on and/or a time duration for which the display device 1000 is off. Then, the characteristic information may be updated in real time and be reflected to generation of the data signal even when a characteristic of the first transistor of each of the pixels PX is changed corresponding to an amount of the pixel PX used. However, this is merely illustrative, and the sensing period SP may be inserted between predetermined display periods DP. Thus, the pixel unit 100 may continuously display an image having uniform image quality.

Figure 4:
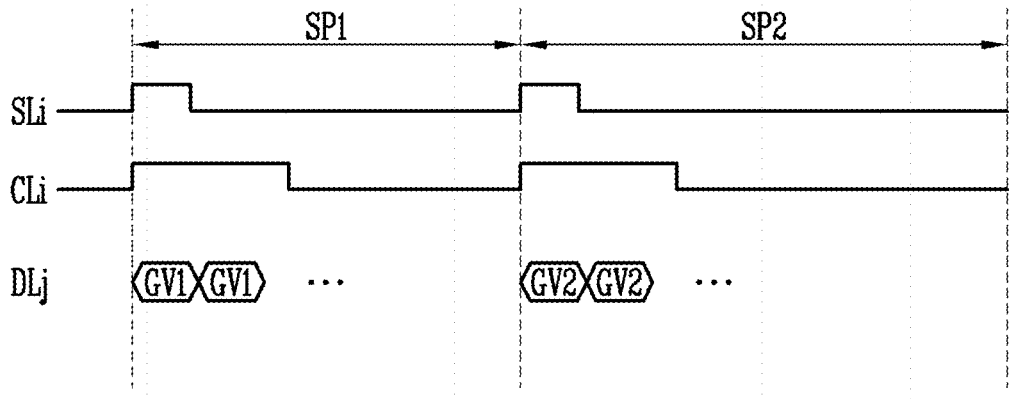
FIG. 4 is a timing diagram illustrating an example of an operation of the display device shown in FIG. 1 in a sensing period.

FIG. 4 is a timing diagram illustrating an example of an operation of the display device shown in FIG. 1 in the sensing period.

Referring to FIGS. 2 to 4, the sensing period SP may include a first sensing period SP1 and a second sensing period SP2.

Current sensing methods of the first sensing period SP1 and the second sensing period SP2 are the substantially same.

In the first sensing period SP1, a first sensing data signal GV1 corresponding to a first grayscale may be supplied to the data line DLj. The first sensing value SV1 may be generated and extracted based on the first sensing data signal GV1.

In the second sensing period SP2, a second sensing data signal GV2 corresponding to a second grayscale may be supplied to the data line DLj. The second sensing value SV2 may be generated and extracted based on the second sensing data signal GV2.

The first grayscale and the second grayscale may be values set by an experiment. That is, the first grayscale and the second grayscale may be set as grayscales which enable errors of the mobility characteristic and the threshold voltage characteristic to be minimized. In an embodiment, when the pixel PX emits light, corresponding to a range of grayscale values 0 to 255, the first grayscale may be grayscale 224, and the second grayscale may be grayscale 128, for example. However, this is merely illustrative, and the first grayscale and the second grayscale are not limited thereto.

Figure 5:
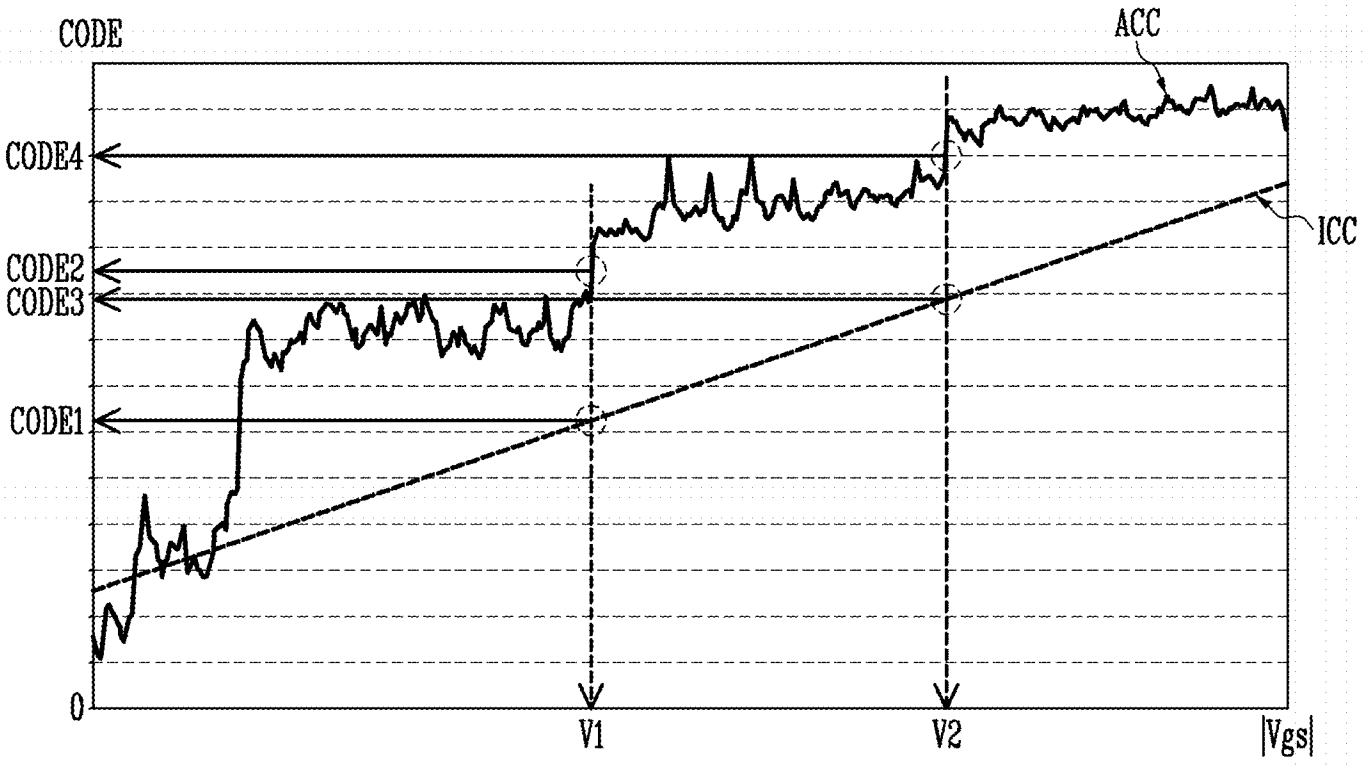
FIG. 5 is a diagram illustrating an example a conversion characteristic of an analog-digital converter included in the sensing circuit shown in FIG. 2 according to a grayscale.

FIG. 5 is a diagram illustrating an example a conversion characteristic of the ADC included in the sensing circuit shown in FIG. 2 according to a grayscale.

FIG. 5 shows output of current code CODE corresponding to sensing value supplied to the ADC 420, based on absolute value |Vgs| of gate-source voltage of the first transistor T1.

Referring to FIGS. 2 and 5, the ADC 420 may convert input sensing values (or voltage) into a digital current code CODE of predetermined bits.

The ADC 420 may serve as an intermediate medium for converting a voltage charged in the sensing capacitor Cse into a current domain. In an embodiment, the ADC 420 may allow an input voltage to correspond to a current code of 12 bits and output the current code, for example.

The compensator 440 may determine a value converted into a current code in a digital form by the ADC 420 as a sensing current (i.e., a drain current of the first transistor) to be used for an operation for calculating a compensation value.

An absolute value |Vgs| of a gate-source voltage may be determined by the magnitude of the data signal or the magnitude of the initialization voltage Vint. In an embodiment, the current code may correspond to a high grayscale as the absolute value |Vgs| of the gate-source voltage increases, and correspond to a low grayscale as the absolute value |Vgs| of the gate-source voltage decreases, for example. In FIG. 5, a grayscale corresponding to a first voltage V1 may be lower than that corresponding to a second voltage V2.

An actual current code output characteristic of the ADC 420 (e.g., designated as ACC shown in FIG. 5) may be different from a theoretical input-output relationship or an input-output relationship to which a predetermined calibration is applied (e.g., designated as ICC shown in FIG. 5). In an embodiment, as shown in FIG. 5, the theoretical input-output relationship ICC may have a form in which the current code linearly increases according to the magnitude of the input voltage, for example. However, the actual current code output characteristic ACC of the ADC 420 may have a non-linear form.

In the case of a conventional method of sensing the threshold voltage and mobility of the first transistor T1 by a sensing data signal corresponding to one grayscale, only a specific current code region may be fixedly used. A single gain may be applied to a code in a corresponding range so as to calibrate an output of the ADC 420.

However, the 2-point current sensing method of the invention has a structure in which the threshold voltage and mobility are sensed by sensing data signals in two grayscale regions, which have high compensation accuracy, and therefore, a compensation error may occur when a single gain is applied.

In an embodiment, when the first voltage V1 and the second voltage V2 are test voltages corresponding to two grayscales, a difference between a second code CODE2 actually output corresponding to the first voltage V1 and an ideal first code CODE1 may be different from that between a fourth code CODE4 actually output corresponding to the second voltage V2 and an ideal third code CODE3, for example. Therefore, different gain values are to be applied to the second code CODE2 and the fourth code CODE4. In an embodiment, a first gain may be applied to the second code CODE2 so as to correct (or calibrate) the second code CODE2 into the first code CODE1, and a second gain different from the first gain may be applied to the fourth code CODE4 so as to correct (or calibrate) the fourth code CODE4 into the third code CODE3.

When the same gain (correction value) is applied to the second code CODE2 and the fourth code CODE4, an output error may occur, and the accuracy of sensing data (e.g., a sensing current) may be lowered.

The code corrector 430 in the embodiments of the invention may differently apply a gain for correcting a current code according to the absolute value |Vgs| of the gate-source voltage and/or the grayscale supplied in the sensing period. Accordingly, an actual conversion variation of the ADC 420 according to an input value is relatively accurately reflected to correction of a current code, so that a compensation error of the compensator 440 may be considerably decreased.

Figure 6A:
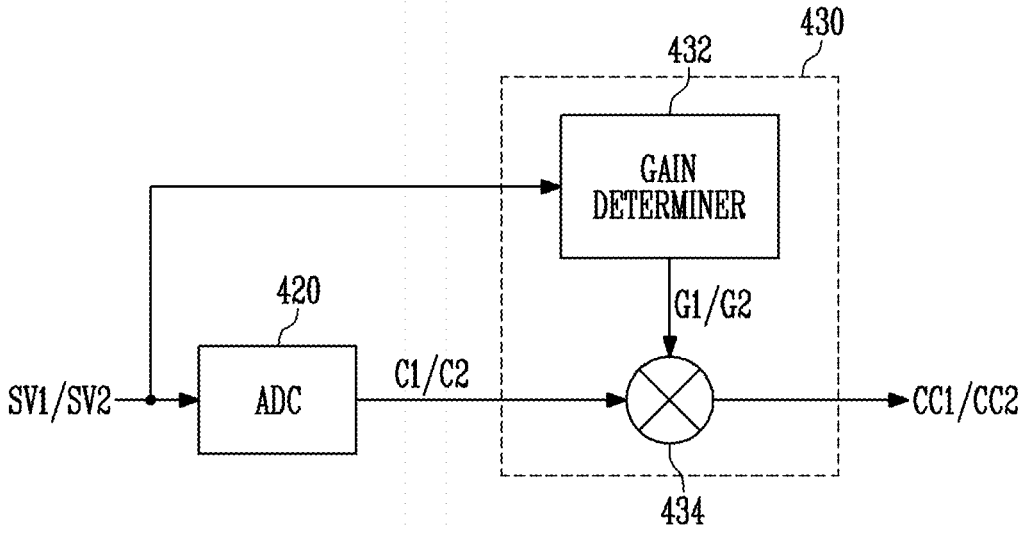
FIGS. 6A to 6C are block diagrams illustrating examples of a code corrector included in the sensing circuit shown in FIG. 2.
Figure 6B:
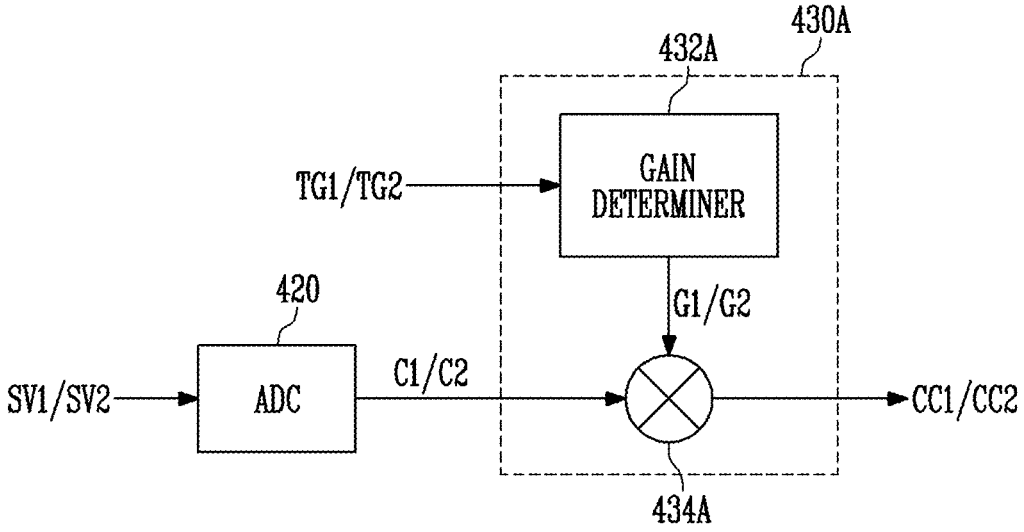
Figure 6C:
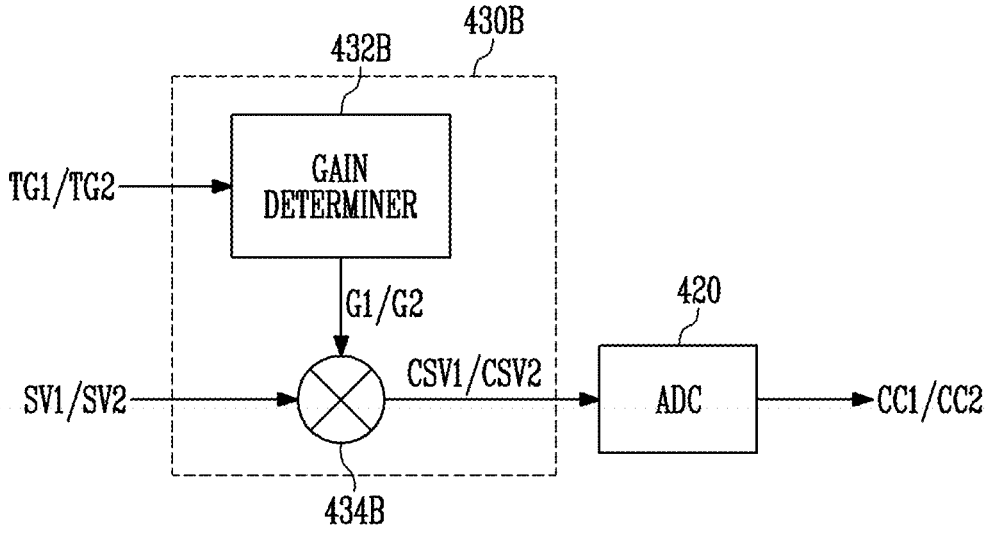

FIGS. 6A to 6C are block diagrams illustrating examples of the code corrector included in the sensing circuit shown in FIG. 2.

Referring to FIGS. 2 and 6A to 6C, a code corrector 430, 430A or 430B may include a gain determiner 432, 432A or 432B and an operating component 434, 434A or 434B.

In an embodiment, as shown in FIGS. 6A and 6B, the code corrector 430 or 430A may correct current codes C1 and C2 output from the ADC 420.

As shown in FIG. 6A, the gain determiner 432 may receive a first sensing value SV1 and a second sensing value SV2, which are supplied from the sensing line SSLj. The gain determiner 432 may determine a first gain G1 corresponding to the first sensing value SV1 and determine a second a second gain G2 corresponding to the second sensing value SV2. The first gain G1 and the second gain G2 may be supplied to the operating component 434.

In an embodiment, the gain determiner 432 may include a lookup table in which gains corresponding to predetermined voltages are stored (refer to FIG. 7A), for example. The gain determiner 432 may output the first gain G1 and the second gain G2, which respectively correspond to voltages corresponding to the first sensing value SV1 and the second sensing value SV2. In an embodiment, the first and second gains G1 and G2 may have a digital form, for example. However, this is merely illustrative, and a component for determining a gain is not limited thereto. In an embodiment, the gain determiner 432 may include a hardware/software component which implements a functional formula having a relationship between an input voltage and a gain, for example. The gain determiner 432 may additionally include a component which determines a gain by interpolating values set in the lookup table.

A gain may be set in a range of 0 to 1. The gain may be determined through an input/output test (experiment) of the ADC 420 before a product is released.

The operating component 434 may be supplied with a first current code C1 and a second current code C2 from the ADC 420, and be supplied with the first gain G1 and the second gain G2 from the gain determiner 432. The operating component 434 may generate a first correction code CC1 by applying the first gain G1 to the first current code C1. Similarly, the operating component 434 may generate a second correction code CC2 by applying the second gain G2 to the second current code C2. In an embodiment, the operating component 434 may include a multiplier which performs a digital multiplication operation on a current code and a gain, for example.

Accordingly, the first correction code CC1 and the second correction code CC2 may have digital values. The first correction code CC1 and the second correction code CC2 may be supplied to the compensator 440.

In some embodiments, at least some of the sensing values SV1 and SV2, the current codes C1 and C2, the gains G1 and G2, and the correction codes CC1 and CC2 may be stored in a memory such as a line buffer and then read when a corresponding operation is necessary.

In an embodiment, as shown in FIG. 6B, the gain determiner 432A may receive a first grayscale TG1 and a second grayscale TG2, which correspond to a sensing data signal supplied to the pixel PXij in the sensing period. The gain determiner 432A may determine a first gain G1 corresponding to the first grayscale TG1 and determine a second gain G2 corresponding to the second grayscale TG2. The first gain G1 and the second gain G2 may be supplied to the operating component 434A.

That is, unlike the embodiment shown in FIG. 6A, the gain determiner 432A shown in FIG. 6B may determine a gain, based on an input grayscale for pixel emission. In an embodiment, the gain determiner 432A may include a lookup table in which gains corresponding to predetermined grayscales (or reference grayscales) are stored (refer to FIG. 7B), for example. The gain determiner 432A may output a first gain G1 and a second gain G2, which respectively correspond to the first grayscale TG1 and the second grayscale TG2, from the lookup table.

The operating component 434A may calculate a first correction code CC1 by applying the first gain G1 to the first current code C1, and calculate a second correction code CC2 by applying the second gain G2 to the second current code C2. The configuration and operation of the operating component 434A are substantially identical to those of the operating component 434 shown in FIG. 6A, and therefore, overlapping descriptions will be omitted.

In an embodiment, as shown in FIG. 6C, the code corrector 430B may provide a first sensing correction value CSV1 and a second sensing correction value CSV2 to the ADC 420 by performing an analog operation.

That is, unlike the embodiment shown in FIG. 6B, the code corrector 430B shown in FIG. 6C may provide the ADC 420 with results obtained by performing a correction operation (e.g., an analog operation) on sensing values SV1 and SV2.

The gain determiner 432B may receive a first grayscale TG1 and a second grayscale TG2, which correspond to a sensing data signal supplied to the pixel PXij in the sensing period. The gain determiner 432B may determine a first gain G1 corresponding to the first grayscale TG1 and determine a second gain G2 corresponding to the second grayscale TG2. The first gain G1 and the second gain G2 may be supplied to the operating component 434B. In an embodiment, the first gain G1 and the second gain G2 may have analog voltage values.

The operating component 434B may receive first and second sensing values SV1 and SV2 in an analog form. The operating component 434B may calculate a first sensing correction value CSV1 by applying the first gain G1 to the first sensing value SV1, and calculate a second sensing correction value CSV2 by applying the second gain G2 to the second sensing value SV2. The operating component 434B may include an analog multiplier which performs an analog multiplication operation.

The first and second sensing correction values CSV1 and CSV2 may be provided to the ADC 420.

As described above, gains for correction of a current code may be adaptively determined according to the voltage levels of the sensing values SV1 and SV2 supplied to the ADC 420 or the grayscales TG1 and TG2 for sensing.

FIG. 7A is a diagram illustrating an example of the gain determiner included in the code corrector shown in FIG. 6A.

Referring to FIGS. 6A and 7A, the gain determiner 432 may include a lookup table in which reference gains RG corresponding to predetermined reference voltages RV are set.

Reference gains RG respectively corresponding to first to ninth reference voltages RV1 to RV9 may be determined by a test performed before a product is released. In an embodiment, reference gain RG 0.692 corresponding to the first reference voltage RV1 may be determined as a gain with respect to a voltage between the first reference voltage RV1 and the second reference voltage RV2. Similarly, reference gain RG 0.688 corresponding to the second reference voltage RV2 may be determined as a gain with respect to a voltage between the second reference voltage RV2 and the third reference voltage RV3.

On the contrary, the reference gain RG 0.688 corresponding to the second reference voltage RV2 may be determined as a gain with respect to the voltage between the first reference voltage RV1 and the second reference voltage RV2, and reference gain RG 0.680 corresponding to the third reference voltage RV3 may be determined as a gain with respect to the voltage between the second reference voltage RV2 and the third reference voltage RV3.

However, this is merely illustrative, and a method of determining a gain from the lookup table according to the magnitude of a voltage supplied from the gain determiner 432 is not limited thereto.

FIG. 7B is a diagram illustrating an example of the gain determiner included in the code correctors shown in FIGS. 6B and 6C.

Referring to FIGS. 6B, 6C, and 7B, the gain determiner 432A or 432B may include a lookup table in which reference gains RG corresponding to predetermined reference voltages RV are set.

That is, unlike FIG. 7A, a gain applied to a current code may be determined with reference to a grayscale of image data supplied for the purpose of sensing.

Reference gains RG respectively corresponding to first to ninth reference grayscales G0, G32, G64, G96, G128, G160, G192, G224, and G255 may be determined by a test performed before a product is released.

A method of determining a gain by the lookup table has been described in detail with reference to FIG. 7A, and therefore, overlapping descriptions will be omitted.

In an embodiment, when 2-point sensing of grayscale 192 G192 and grayscale 128 G128 is performed, the output of the ADC 420 before gain application may be code 1408 with respect to the grayscale 192 G192, and be code 945 with respect to the grayscale 128 G128, for example. However, based on the lookup table of the gain determiner 432A or 432B, a gain of the grayscale 192 G192 is 0.680 and a gain of the grayscale 128 G128 is 0.672. The gains may be determined as different values.

Therefore, a final correction code in sensing of the grayscale 192 G192 may be determined as code 957 (1408*0.680, truncation of decimal points), and a final correction code in sensing of the grayscale 128 G128 may be determined as code 634 (945*0.672, truncation of decimal points).

As described above, a gain for correcting a current code is reflected for each grayscale supplied for purpose of external compensation, so that a compensation error according to the conversion characteristic of the ADC 420 may be decreased or minimized.

Figure 8:
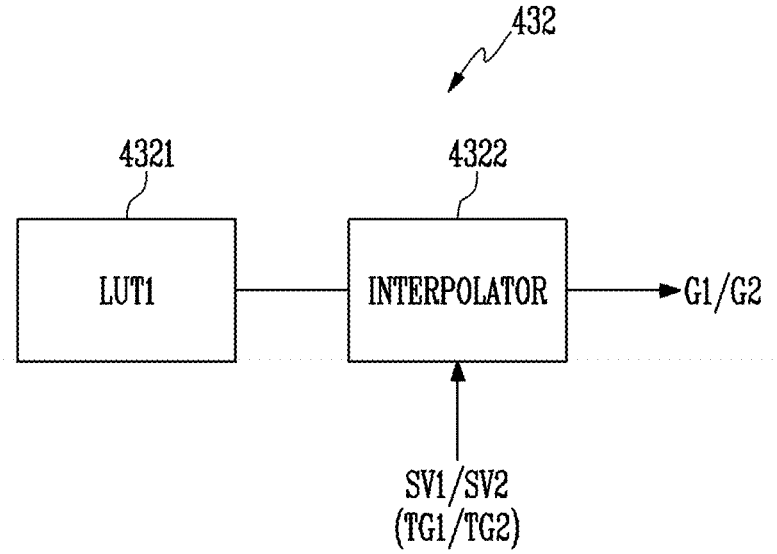
FIG. 8 is a diagram illustrating another example of the gain determiner included in the code corrector shown in FIG. 6A.

FIG. 8 is a diagram illustrating another example of the gain determiner included in the code corrector shown in FIG. 6A.

Referring to FIGS. 6A to 8, the gain determiner 432 may include a lookup table 4321 and an interpolator 4322.

The lookup table 4321 may include a relationship between a voltage and a gain or a relationship between a grayscale and a gain. The lookup table 4321 has been described in detail with reference to FIG. 7A or 7B, and therefore, overlapping descriptions will be omitted.

The interpolator 4322 may calculate a first gain G1 corresponding to a first sensing value SV1 by interpolating some of reference voltages RV with respect to the first sensing value SV1, and calculate a second gain G2 corresponding to a second sensing value SV2 by interpolating some of the reference voltages RV with respect to the second sensing value SV2. In an embodiment, referring to FIGS. 7A and 8, with respect to a voltage between the first reference voltage RV1 and the second reference voltage RV2, a gain corresponding to the corresponding voltage may be determined by various interpolation methods using the first reference voltage RV1, the second reference voltage RV2, a first reference gain (e.g., 0.692), and a second reference gain (e.g., 0.688), for example.

In an embodiment, the interpolator 4322 may calculate a first gain G1 corresponding to a first grayscale TG1 by interpolating some of reference grayscales RGL with respect to the first grayscale TG1, and calculate a second gain G2 corresponding to a second grayscale TG2 by interpolating some of the reference grayscales RGL with respect to the second grayscale TG2. In an embodiment, referring to FIGS. 7B and 8, with respect to a grayscale between the grayscale 192 G192 and the grayscale 224 G224, a gain corresponding to the corresponding grayscale may be determined by various interpolation methods using the grayscale 192 G192, the grayscale 224 G224, a reference gain RG 0.680, and reference gain RG 0.688, for example.

Accordingly, gains for correcting a current code according to the voltage levels of the sensing values SV1 and SV2 or the grayscales TG1 and TG2 for sensing may be adaptively determined. Thus, an error of a current code according to the conversion characteristic of the ADC 420 may be decreased.

Figure 9:
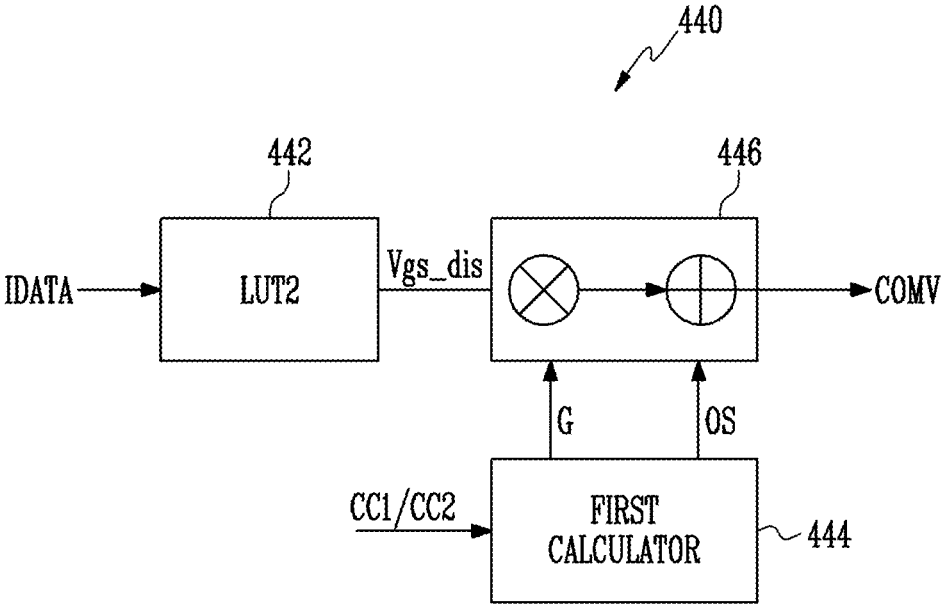
FIG. 9 is a block diagram illustrating an example of a compensator included in the sensing circuit shown in FIG. 2.

FIG. 9 is a block diagram illustrating an example of the compensator included in the sensing circuit shown in FIG. 2.

Referring to FIGS. 1 to 9, the compensator 440 may include a lookup table 442, a first operating component 444, and a second operating component 446.

The compensator 440 may calculate a mobility characteristic and a threshold voltage characteristic of the first transistor T1 by a first correction code CC1 and a second correction code CC2. The compensator 440 determines a compensation value COMV of input image data IDATA, based on the calculated mobility characteristic and the calculated threshold voltage characteristic.

In image display and sensing, a source voltage Vs (refer to FIG. 10) is fixed to the initialization voltage Vint, and therefore, degradation of the first transistor T1 may be compensated by controlling a gate voltage of the first transistor T1 with respect to a predetermined grayscale.

That is, the compensation value COMV may be a value for controlling a data signal (i.e., a voltage supplied to the gate electrode of the first transistor T1) corresponding to the predetermined grayscale.

The lookup table 442 may output a first gate-source voltage Vgs_dis corresponding to the input image data IDATA. In an embodiment, the lookup table 442 may include a digital-analog converter, for example. Also, the lookup table 442 may be updated as a relationship between new input image data IDATA and a new gate-source voltage Vgs_dis whenever image data is compensated.

In an embodiment, when a first grayscale corresponding to a first sensing data signal is supplied to the lookup table 442, the lookup table 442 may output a first gate-source voltage corresponding to the first grayscale, for example. When a second grayscale corresponding to a second sensing data signal is supplied to the lookup table 442, the lookup table 442 may output a second gate-source voltage corresponding to the second grayscale.

The first operating component 444 may calculate a gain G and an offset OS, which are used to compensate for the gate-source voltage Vgs_dis, based on the first correction code CC1 and the second correction code CC2. The first correction code CC1 may correspond to a first sensing current, and the second correction code CC2 may correspond to a second sensing current.

The first operating component 444 may calculate the gain G including the mobility characteristic and the offset OS including the threshold voltage characteristic, based on the following Equation 1.

$$Id = \frac{1}{2}\beta(Vgs - Vth)^2 \qquad \text{Equation 1}$$

Id may denote a driving current, β may denote a variable including the mobility characteristic, Vgs may denote a gate-source voltage, and Vth may denote a threshold voltage.

In Equation 1, a first sensing current (e.g., Id1) corresponding to the first correction code CC1 or a second sensing current (e.g., Id2) corresponding to the second correction code CC2 is applied to the driving current Id, the gate-source voltage Vgs is a constant caused by the first sensing data signal (GV1 shown in FIG. 4) or the second sensing data signal (GV2 shown in FIG. 4), and 13 and Vth are variables.

Therefore, the first operating component 444 may calculate β and Vth through interpretation of two simultaneous equations caused by the first sensing current Id1 and the second sensing current Id2. The gain G may include a mobility characteristic β, and be multiplied by the gate-source voltage Vgs_dis. The offset OS may include a threshold voltage Vth characteristic, and be added to the gate-source voltage Vgs_dis. That is, the first operating component 444 may simultaneously calculate the mobility characteristic 13 and the threshold voltage Vth characteristic by the first and second correction codes CC1 and CC2.

The second operating component 446 may calculate a compensation value COMV for compensating for the gate-source voltage Vgs_dis. In an embodiment, the second operating component 446 may multiply the gate-source voltage Vgs_dis by the gain G, and add the offset OS to the value obtained by multiplying the gate-source voltage Vgs_dis by the gain G. Accordingly, a compensation value COMV for one input image data IDATA corresponding to one pixel PX may be calculated. The compensation value COMV may correspond to a voltage obtained by newly updating the gate-source voltage Vgs_dis. The input image data IDATA may be compensated to correspond to a voltage of a newly updated data signal, based on the compensation value COMV.

As described above, the mobility characteristic β and the threshold voltage Vth characteristic of the first transistor T1 are simultaneously calculated based on the first and second correction codes CC1 and CC2 (i.e., sensing currents) sensed by the 2-point current sensing method, and image data may be compensated. A characteristic variation of the ADC 420 according to a grayscale for sensing is corrected, and thus errors of the calculated mobility characteristic β and the calculated threshold voltage Vth characteristic are considerably decreased. Accordingly, compensation efficiency may be maximized, and image quality may be improved.

Figure 10:
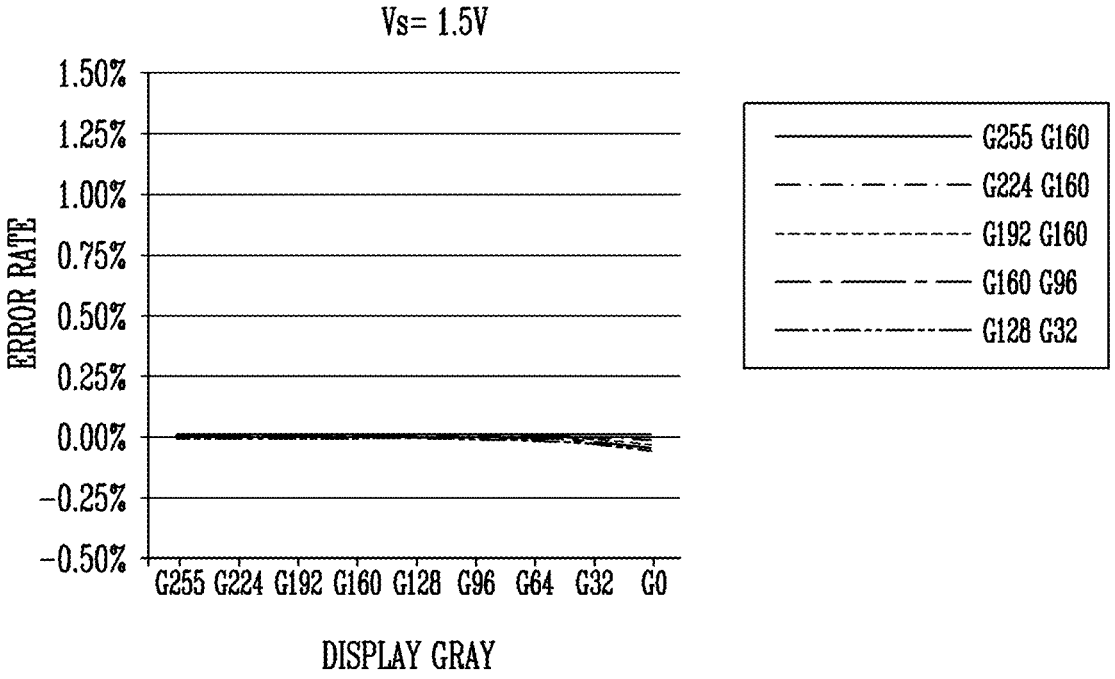
FIG. 10 is a graph schematically illustrating an embodiment of an error rate of an external compensation method in accordance with the invention.

FIG. 10 is a graph schematically illustrating an embodiment of an error rate of an external compensation method in accordance with the invention.

Referring to FIG. 10, the error rate of the external compensation method based on driving current sensing for a first grayscale and a second grayscale may be changed depending on a value of the first grayscale and a value of the second grayscale.

FIG. 10 shows an error rate of a display grayscale in a state in which the source voltage Vs of the first transistor T1 is initialized to 1.5 volts (V). G255, G244, G192, and the like may correspond to a first grayscale and a second grayscale, which are set for the purpose of current sensing.

The display device 1000 in the embodiments of the invention may reflect an error caused by the conversion characteristic of the ADC according to the magnitude of a voltage supplied to the ADC in 2-point current sensing. That is, when current sensing on the first grayscale is performed, a first gain corresponding to the first grayscale or first sensing value may be applied to the current code. When current sensing on the second grayscale is performed, a second gain corresponding to the second grayscale or second sensing value may be applied to the current code.

Thus, the error caused by the conversion characteristic of the ADC is removed or minimized, and the error rate of the external compensation method according to the 2-point current sensing may be considerably improved. Accordingly, the degradation compensation efficiency and the image quality of the pixel and the display device may be improved.

Figure 11:
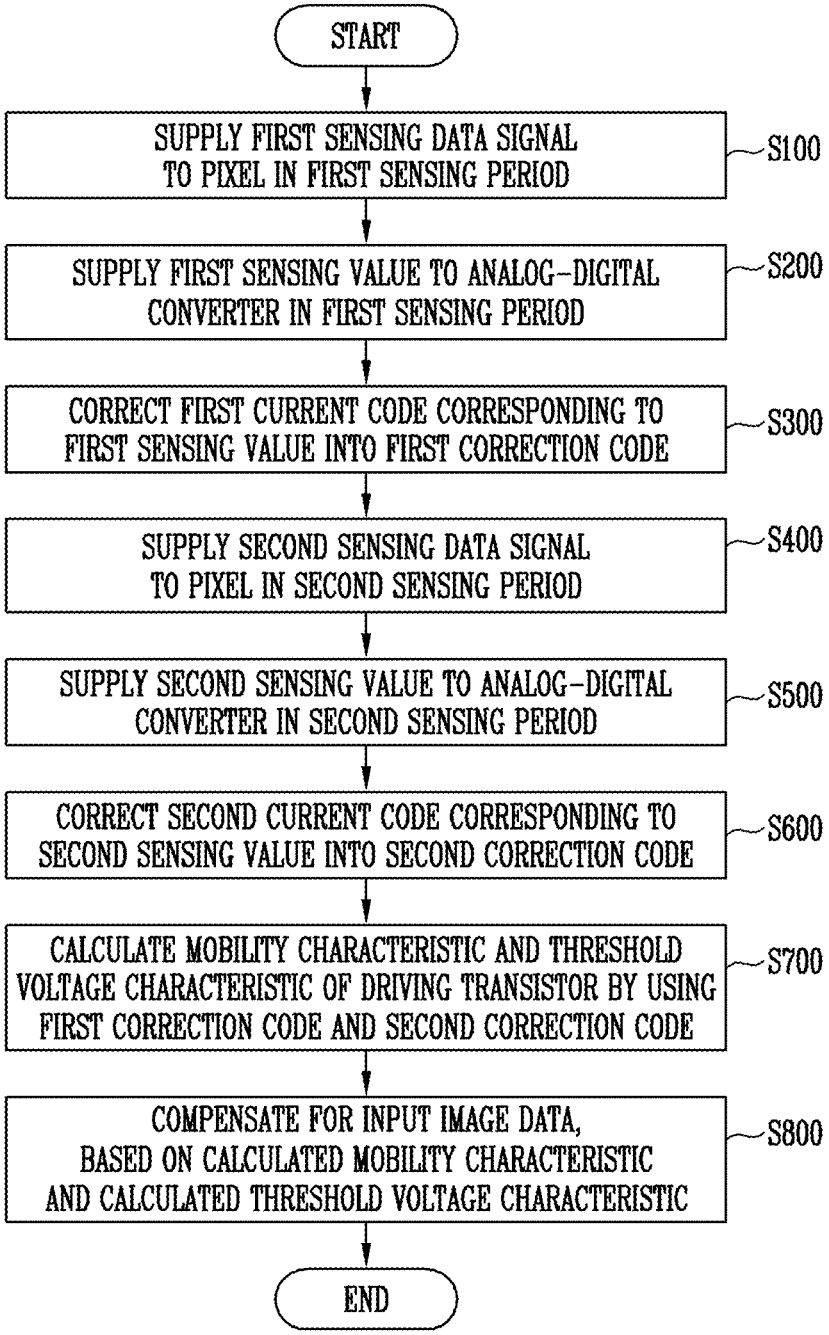
FIG. 11 is a flowchart illustrating an embodiment of a method of driving the display device in accordance with the invention.

FIG. 11 is a flowchart illustrating an embodiment of a method of driving the display device in accordance with the invention.

Referring to FIG. 11, in the method, a first sensing data signal corresponding to a first grayscale (or first test grayscale) may be supplied to a pixel in a first sensing period (S100), a first sensing value generated by the first sensing data signal from the pixel may be supplied to the ADC in the first sensing period (S200), and a first current code corresponding to the first sensing value may be corrected into a first correction code by reflecting a conversion characteristic of the ADC (S300). Also, in the method, a second sensing data signal corresponding to a second grayscale may be supplied to the pixel in a second sensing period (S400), a second sensing value generated by the second sensing data signal from the pixel may be supplied to the ADC in the second sensing period (S500), and a second current code corresponding to the second sensing value may be corrected into a second correction code by reflecting the conversion characteristic (S600). Subsequently, in the method, a mobility characteristic and a threshold voltage characteristic of the driving transistor of the pixel may be simultaneously calculated using the first correction code and the second correction code (S700).

In an embodiment, the first correction code may be calculated by applying a first gain corresponding to the first sensing value or the first grayscale to the first current code, and the second correction code may be calculated by applying a second gain corresponding to the second sensing value or the second grayscale.

The mobility characteristic and the threshold voltage characteristic of the driving transistor may be simultaneously calculated through the first sensing period and the second sensing period. As compared with a conventional external compensation method in which an operation for sensing a mobility characteristic and an operation for sensing a threshold voltage characteristic are different from each other, in the method of the invention, the mobility characteristic and the threshold voltage characteristic may be simultaneously calculated using two sensing currents sensed in the first and second sensing periods. Thus, sensing time may be reduced, and the accuracy of sensing in real time may be improved.

In an embodiment, the method may further include compensating for input image data, based on the calculated characteristics of the driving transistor (S800).

The method has been described in detail with reference to FIGS. 1 to 9, and therefore, overlapping descriptions will be omitted.

As described above, in the display device and the method of driving the same in the embodiments of the invention, a gain for compensating for a current code may be adaptively applied according to the magnitude of a voltage input to the ADC and/or the level of a grayscale supplied in the sensing period. Thus, an actual conversion variation of the ADC according to an input or grayscale is relatively accurately reflected in correction of a current code, so that a compensation error of the external compensation method according to the 2-point current sensing may be considerably decreased. Accordingly, compensation efficiency may be maximized, and image quality may be improved.

Embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the invention.

What is claimed is:

1. A display device driven in a display period for displaying an image and a sensing period for sensing characteristics of a driving transistor included in each of pixels, the display device comprising:

the pixels coupled to scan lines, control lines, data lines, and sensing lines;

a scan driver which supplies a scan signal to the scan lines and supplies a control signal to the control lines;

a data driver which supplies one of an image data signal and a sensing data signal to the data lines; and a sensing circuit which includes an analog-digital converter which converts a sensing value supplied through the sensing lines into a current code in a digital form such that the sensing circuit corrects the current code by reflecting a conversion characteristic of the analog-digital converter, and senses the characteristics of the driving transistor based on a corrected current code, wherein the sensing period includes a first sensing period in which a first sensing value is extracted based on a first sensing data signal corresponding to a first grayscale and a second sensing period in which a second sensing value is extracted based on a second sensing data signal corresponding to a second grayscale, wherein the analog-digital converter generates a first current code corresponding to the first sensing value or the first grayscale and a second current code corresponding to the second sensing value or the second grayscale, corrects the first current code into a first correction code and a second correction code, based on a first gain corresponding to the first sensing value or the first grayscale, and corrects the second current code into a second correction code, based on a second gain corresponding to the second sensing value or the second grayscale, and wherein the sensing circuit further comprises:

a lookup table in which reference gains corresponding to predetermined reference voltages or reference grayscales are set; and an interpolator which calculates the first gain and the second gain by interpolating some of the predetermined reference voltages with respect to each of the first sensing value and the second sensing value or interpolating some of the predetermined reference grayscales with respect to each of the first grayscale and the second grayscale.

2. The display device of claim 1, wherein the data driver:

supplies the first sensing data signal to at least one of the pixels in the first sensing period; and supplies the second sensing data signal to at least one of the pixels in the second sensing period.

3. The display device of claim 1, wherein the sensing circuit simultaneously calculates a mobility characteristic and a threshold voltage characteristic of the driving transistor by the first sensing value and the second sensing value.

4. The display device of claim 1, wherein the sensing circuit further comprises:

a code corrector which corrects the first current code and the second current code respectively into the first correction code and the second correction code, based on the first sensing value and the second sensing value, which are supplied to the analog-digital converter; and a compensator which calculates a mobility characteristic and a threshold voltage characteristic of the driving transistor by performing an operation on the first correction code and the second correction code, and determines a compensation value of image data based on the mobility characteristic and the threshold voltage characteristic.

5. The display device of claim 4, wherein the code corrector comprises:

a gain determiner which determines the first gain corresponding to the first sensing value and the second gain corresponding to the second sensing value; and an operating component which calculates the first correction code by applying the first gain to the first current code, and calculates the second correction code by applying the second gain to the second current code.

6. The display device of claim 4, wherein the sensing circuit further comprises:

a memory which stores at least one of the first correction code and the second correction code.

7. The display device of claim 1, wherein the sensing circuit further comprises:

a code corrector which corrects the first current code and the second current code respectively into the first correction code and the second correction code, based on the first grayscale and the second grayscale; and a compensator which simultaneously calculates a mobility characteristic and a threshold voltage characteristic of the driving transistor by performing an operation on the first correction code and the second correction code, and determines a compensation value of image data based on the mobility characteristic and the threshold voltage characteristic.

8. The display device of claim 7, wherein the code corrector comprises:

a gain determiner which determines the first gain corresponding to the first grayscale and the second gain corresponding to the second grayscale; and an operating component which calculates the first correction code by applying the first gain to the first current code, and calculates the second correction code by applying the second gain to the second current code.

9. The display device of claim 7, wherein the code corrector comprises:

a gain determiner which determines the first gain corresponding to the first grayscale and the second gain corresponding to the second grayscale; and an operating component which calculates a first sensing correction value by applying the first gain to the first sensing value, and calculates a second sensing correction value by applying the second gain to the second sensing value, wherein the analog-digital converter converts the first sensing correction value and the second sensing correction value respectively into the first correction code and the second correction code.

10. The display device of claim 1, wherein a pixel disposed on an i-th, (i is an integer greater than zero) horizontal line among the pixels comprises:

a first transistor controlling a current flowing in a second node from a first power source, corresponding to a voltage of a first node, the first transistor corresponding to the driving transistor;

a second transistor coupled between the first node and one of the data lines, the second transistor including a gate electrode coupled to an i-th scan line;

a third transistor coupled between the second node and one of the sensing lines, the third transistor including a gate electrode coupled to an i-th control line; and a storage capacitor coupled between the first node and the second node.

11. The display device of claim 10, wherein a length of the control signal supplied in the sensing period is longer than a length of the control signal supplied in the display period.

12. The display device of claim 10, wherein, in the sensing period, a portion of the control signal supplied to the i-th control line overlaps with the scan signal supplied to the i-th scan line, and the control signal is supplied for a longer time duration than a time duration for which the scan signal is supplied.

13. A method of driving a display device, the method comprising:

supplying, to a pixel, a first sensing data signal corresponding to a first grayscale, in a first sensing period;

supplying, to an analog-digital converter, a first sensing value sensed by the first sensing data signal from the pixel, in the first sensing period;

calculating a first gain corresponding to the first sensing value by interpolating some of predetermined reference voltages with respect to the first sensing value;

correcting a first current code corresponding to the first sensing value into a first correction code by reflecting a conversion characteristic of the analog-digital converter according to a grayscale applying the first gain to the first current code;

supplying, to the pixel, a second sensing data signal corresponding to a second grayscale, in a second sensing period;

supplying, to the analog-digital converter, a second sensing value generated by the second sensing data signal from the pixel, in the second sensing period;

calculating a second gain corresponding to the second sensing value by interpolating some of the predetermined reference voltages with respect to the second sensing value;

correcting a second current code corresponding to the second sensing value into a second correction code by reflecting the conversion characteristic applying the second gain to the second current code; and simultaneously calculating a mobility characteristic and a threshold voltage characteristic of a driving transistor of the pixel by the first correction code and the second correction code, wherein the first sensing data signal and the second sensing data signal are different from each other.

14. The method of claim 13, further comprising:

compensating for input image data, based on the mobility characteristic and the threshold voltage characteristic.

* * * * *